US006890125B1

(12) United States Patent
Calder et al.

(10) Patent No.: US 6,890,125 B1
(45) Date of Patent: May 10, 2005

(54) ADJUSTABLE SCREED SYSTEM

(75) Inventors: Wayne D. Calder, Simpsonville, SC (US); David M. Calder, Taylors, SC (US)

(73) Assignee: Calder Brothers Corporation, Greenville, SC (US)

( * ) Notice: Subject to any disclaimer, the term of this patent is extended or adjusted under 35 U.S.C. 154(b) by 0 days.

(21) Appl. No.: 10/355,129

(22) Filed: Jan. 30, 2003

Related U.S. Application Data

(60) Provisional application No. 60/353,079, filed on Jan. 30, 2002.

(51) Int. Cl.[7] ..... E01C 19/22
(52) U.S. Cl. ..... 404/104; 404/118
(58) Field of Search ..... 404/101, 104, 404/118, 119, 84.05, 84.1, 84.2, 84.5, 84.8

(56) References Cited

U.S. PATENT DOCUMENTS

| | | | | |
|---|---|---|---|---|
| 4,379,643 A | | 4/1983 | Halicho | |
| 4,702,642 A | | 10/1987 | Musil | |
| 4,722,636 A | * | 2/1988 | Brock | 404/84.1 |
| 5,222,829 A | * | 6/1993 | Mogler et al. | 404/118 |
| 5,356,238 A | * | 10/1994 | Musil et al. | 404/84.1 |
| 5,401,115 A | * | 3/1995 | Musil et al. | 404/72 |
| 5,568,992 A | * | 10/1996 | Grembowicz et al. | 404/101 |
| 5,924,819 A | * | 7/1999 | Breidenbach | 404/96 |
| 6,056,474 A | * | 5/2000 | Nolan | 404/118 |
| 6,158,921 A | * | 12/2000 | Holmes | 404/104 |
| 6,161,987 A | * | 12/2000 | Holmes et al. | 404/104 |
| 6,174,105 B1 | * | 1/2001 | Holmes et al. | 404/104 |
| 6,203,243 B1 | | 3/2001 | Birtchet | |

FOREIGN PATENT DOCUMENTS

JP 11350418 A * 12/1999 ..... E01C/19/48

* cited by examiner

*Primary Examiner*—Robert E. Pezzuto
*Assistant Examiner*—Alexandra K. Pechhold
(74) *Attorney, Agent, or Firm*—Thomas W. Epting; Leatherwood Walker Todd & Mann, P.C.

(57) ABSTRACT

A mechanical linkage having a geometry designed to substantially hold the plane of a main screed and the plane of an extension screed at a generally constant relative angle with respect to one another through a predetermined range of screed depth adjustments. The linkage is configured to allow the extension screed to be raised and lowered by an amount sufficient to compensate for angle of attack and elevation changes in the main screed. In particular, the linkage compensates for the effect of the radial distance differences from the axis of rotation of tow bars of the main screed and extension screed as the main screed pivots with respect to the tow point of the tow bars for different asphalt mat depths. An alternate embodiment includes actuators, together with sensors, for sensing the position of the extension screed with respect to the main screed and automatically compensating for changes in main screed position to properly orient the extension screed with respect to the main screed.

14 Claims, 11 Drawing Sheets

ADJUSTABLE SCREED SYSTEM

This application claims benefit of U.S. Provisional application Ser. No. 60/353,079, filed Jan. 30, 2002, the entirety of the disclosure of which is incorporated herein by reference thereto.

BACKGROUND OF THE INVENTION

The present invention relates to a system for adjusting an auxiliary, or, extension, screed of a paving machine with respect to a main screed.

In conventional asphalt paving operations, a self-propelled vehicle, known as a "tractor" is used having a hopper on the front end thereof. This hopper receives asphalt paving material, typically from a dump truck, and the tractor generally engages and pushes the truck forwardly as the truck empties its contents into the hopper.

The asphalt material is transferred from the hopper to the roadbed or other surface being paved, and the asphalt empties onto the roadbed in front of transversely extending screw augers. These augers transport the asphalt material laterally in front of an elongated plate, or "screed", which compresses and compacts the asphalt downwardly to form a "mat" of paving material, ideally of uniform thickness and surface finish.

The screed is typically pulled behind the tractor and may move upwardly or downwardly with respect to the tractor, such screed being connected to the tractor by tow arms, or bars. The tow bars are pivotally connected to the tractor and pivot about an axis, or "tow points." This arrangement effectively allows the screed to "float" with respect to the tractor as the screed is towed behind the tractor.

In order to control the thickness of the asphalt mat being formed by the asphalt screed, the height of the screed is generally varied by positioning the tow bars at selected elevations. The angle of attack of the screed must also be controlled to achieve the desired asphalt mat thickness and surface finish, and this is typically done by means of a crank at each end of the screed, rotation of the cranks causing corresponding height adjustments on each end of the screed.

A conventional screed is of a set width. However, in certain paving applications, particularly in applications such as driveways, parking lots, and the like, where varying asphalt mat widths are required, an adjustable, or extendable, screed arrangement is desirable. Extendable screeds have become common in the asphalt paving industry to achieve varying widths of a paved surface without interruption of the paving process. Typically, extendable screeds consist of a main screed section of fixed width and hydraulically extendable auxiliary screed sections capable of extending from each end of the main screed unit, such auxiliary sections generally being referred to as "extensions" or "extension screeds."

In the normal operation of an asphalt paver, an operator makes adjustments in the attack angle of the screed to affect the depth of the asphalt mat being laid. This is achieved by raising or lowering the tow point on the tractor with a hydraulic cylinder unit, or more commonly in smaller paving machines, with the rotatable cranks. The cranks cause the main screed to pivot relative to the tow arm attached to the tractor, to thereby change the angle of attack of the main screed with respect to the direction of travel. With each of these adjustments of the main screed, the corresponding position of the extension screed will change due to the fact that it is mounted to the main screed. In other words, the extension screed is slaved to the movement of the main screed.

When the asphalt mat thickness changes, and the main screed is adjusted to float at a new paving depth, the main screed and extension screed will move about an arc with respect to the axis of rotation of the tow bars and with respect to the tractor. Consequently, this rotation of the screed about the tow point axis induces a change in the extension screed elevation with respect to the main screed elevation, since the extension screed, which either leads or trails the main screed, rotates in an arc having a different radial distance from the axis of rotation, than does the main screed. For example, the extension screed, if it is positioned in front of the main screed, moves through an arc having a shorter radial distance with respect to the main screed, or, in the event the extension screed follows behind the main screed, the extension screed would rotate through an arc having a longer radial distance compared to the main screed. In either case, the screed extension rotates to an elevation which is different relative to the main screed, and this creates a discontinuity, or "step", between the asphalt mat formed by the main screed and the asphalt mat formed by the extension screed. This step is undesirable in that it results in an overall asphalt mat having a height difference in the surface thereof.

The extension screeds are preferably adjusted such that the asphalt mat surface produced by such screeds is matched to the surface of the main screed, and there is no step or discontinuity between the mat heights. The physical characteristics of the screeds being used and the depth of the asphalt mat being formed ordinarily influence the frequency and the degree to which the extension screeds require adjustment. Further, other factors contribute to the extension screed adjustment, such as the weight of the screed mechanism towed by the tractor, the length of the main and extension screed plates itself from front to rear, and the relative location of the trailing edge-of the extension screed plate in relation to the trailing edge of the main screed plate.

In order to avoid a step or discontinuity in the mat, operators generally attempt to adjust the height of the extension screed relative to the main screed. This may result in a trial and error approach which can be time consuming and inefficient.

When smaller paving machines are used, such as the type ordinarily used to form residential driveways, parking areas, and the like, the length of the tow arms is shorter than on larger paving machines. The relatively short length of the tow arms of the small utility paver thus make the effect of depth differentials between the main screed mat and the extension screed mat more pronounced and dramatic, and the requisite skill in adjusting for such mat height differentials more acute. Given the general utility nature of such paving machines and the variety of applications which they encounter, frequent depth adjustment of the mat being formed is common. Thus, the operator of the paver must constantly closely monitor the paving operation, and often times the matching of the mat heights for the main and extension screeds is performed inadequately.

Devices for adjusting the extension screeds for paving machines have been patented. For example, U.S. Pat. No. 4,379,653, issued to Brown; U.S. Pat. No. 4,702,642, issued to Musil; U.S. Pat. No. 6,203,243B1, issued to Birtchet; and U.S. Pat. No. 5,222,829, issued to Mogler, et al., disclose screed adjustment arrangements.

Accordingly, there exists a need for a reliable, and easy to use screed adjustment system for use on paving machines.

SUMMARY OF THE INVENTION

It is, therefore, an object of the present invention to provide an adjustable screed system for a paving machine.

Another object of the present invention is to provide an adjustable screed system having means for allowing a main screed and an extension screed to be simultaneously adjusted with respect to one another through use of a single adjustment means.

Yet another object of the present invention is to provide an adjustable screed system having a mechanical link between a main screed and an extension screed for allowing simultaneous adjustment of both the main and extension screeds.

Another object of the present invention is to provide an adjustable screed system having a single crank on each end of a main screed for allowing each end of the main screed and the extension screed to be simultaneously adjusted through use of the cranks.

A further object of the present invention is to provide an adjustable screed system having automated means for adjusting an extension screed with respect to a main screed.

A still further object of the present invention is to provide a method for adjusting a main screed and an extension screed.

The present invention includes, in a preferred embodiment, a mechanical linkage having a geometry designed to substantially hold the plane of the main screed and the plane of an extension screed at a generally constant relative angle with respect to one another through a predetermined range of screed depth adjustments. The linkage is configured to allow the extension screed to be raised and lowered by an amount sufficient to compensate for attack angle and elevation changes in the main screed. In particular, the linkage compensates for the effect of the radial distance differences from the axis of rotation of the tow bars (connected to the tractor) of the main screed and extension screed as the main screed pivots around the tow point of the tow bars for different asphalt mat depths.

In another embodiment, the present invention includes powered actuators, such as hydraulic or pneumatic cylinders, motorized mechanisms, etc., together with sensors, which effectively sense the position of the extension screed with respect to the main screed and automatically compensate for changes in position of the main screed to properly orient the extension screed with respect to the main screed.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
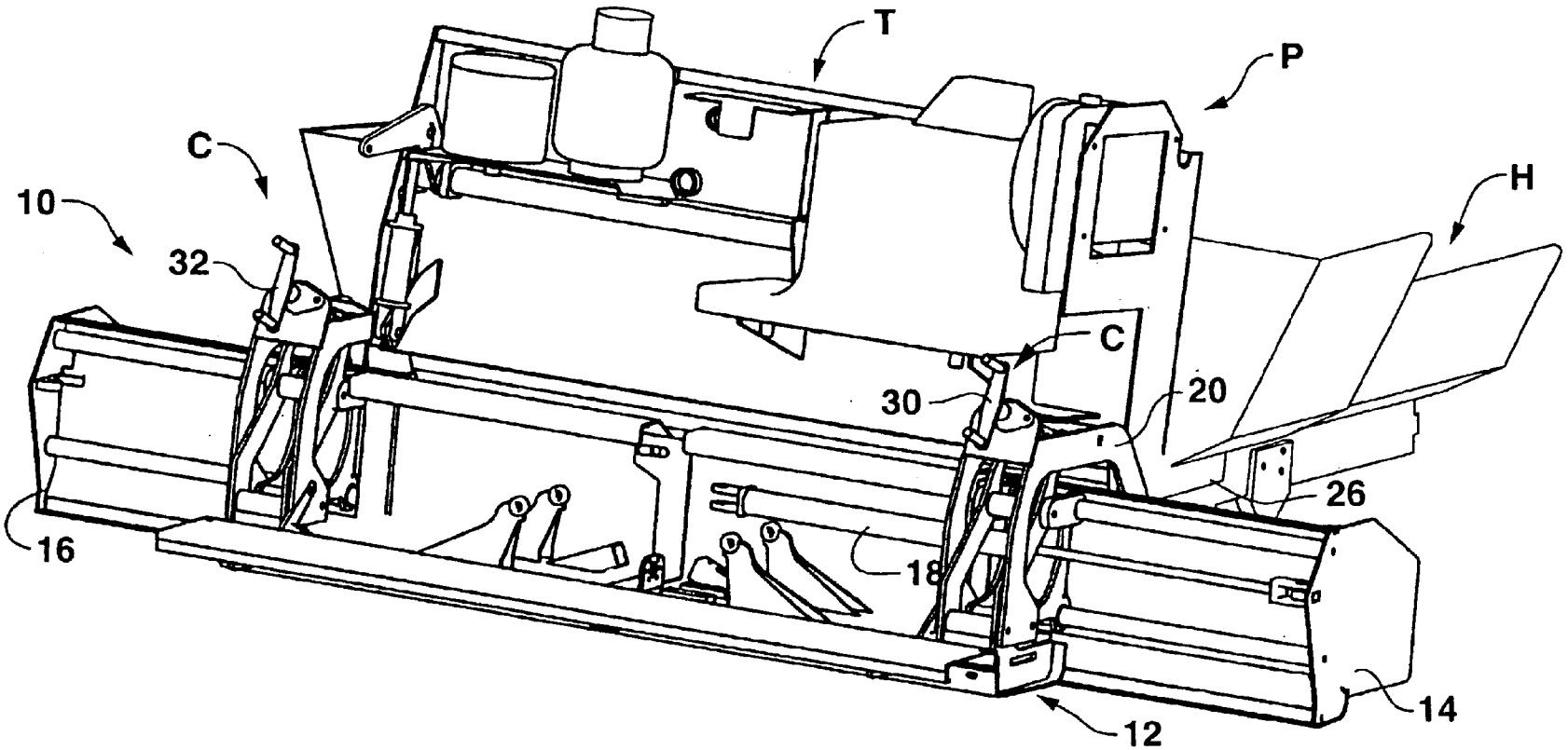
FIG. 1 is a perspective view of a paving machine having an adjustable screed system constructed in accordance with the present invention, showing a screed extension in an extended position.

The accompanying drawings and the description which follows set forth this invention in its preferred embodiment. However, it is contemplated that persons generally familiar with paving equipment and techniques will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the adjustable screed system of the present invention is indicated generally in the figures by reference character 10.

Referring now in more detail to the embodiment chosen for the purposes of illustrating the present invention, FIG. 1 illustrates a paving machine, generally P, having a tractor portion, generally T, and a trailing, screed portion 10 incorporating the present invention. Screed portion 10 includes a main screed, generally 12, and extension screeds, generally 14 and 16. Extension screeds 14, 16 are configured for moving inwardly and outwardly with respect to main screed 12, and are shown in an extended position, in FIG. 1. Hydraulic cylinders 18, are connected both to main screed 12 and extension screeds 14, 16 and serve to extend and retract extension screeds 14, 16 with respect to main screed 12.

Screed system 10 is towed by tractor T during use, and screed system 10 is connected to tractor T by tow bars, or, arms, generally 20, 22. Tow arms 20, 22 are allowed to pivot with respect to tractor T about a pivot axis via receivers 23 on conventional pivot pins (not shown) on each side of tractor T, only one of which being illustrated in FIG. 1. Tow arms 20, 22 are connected to screed 12 by pins 58, and pivot with respect thereto.

Also connected to screed 12 are two actuator, or, crank arrangements, generally C, one crank 30 being positioned on one end of screed 12, and the other crank 32 being positioned on the other end of screed 12. Rotation of cranks 30, 32 control the paving depth of main screed 12, and in the present invention, also control the paving depth of extension screeds 14, 16 in a manner to be described in more detailed below.

Figure 2:
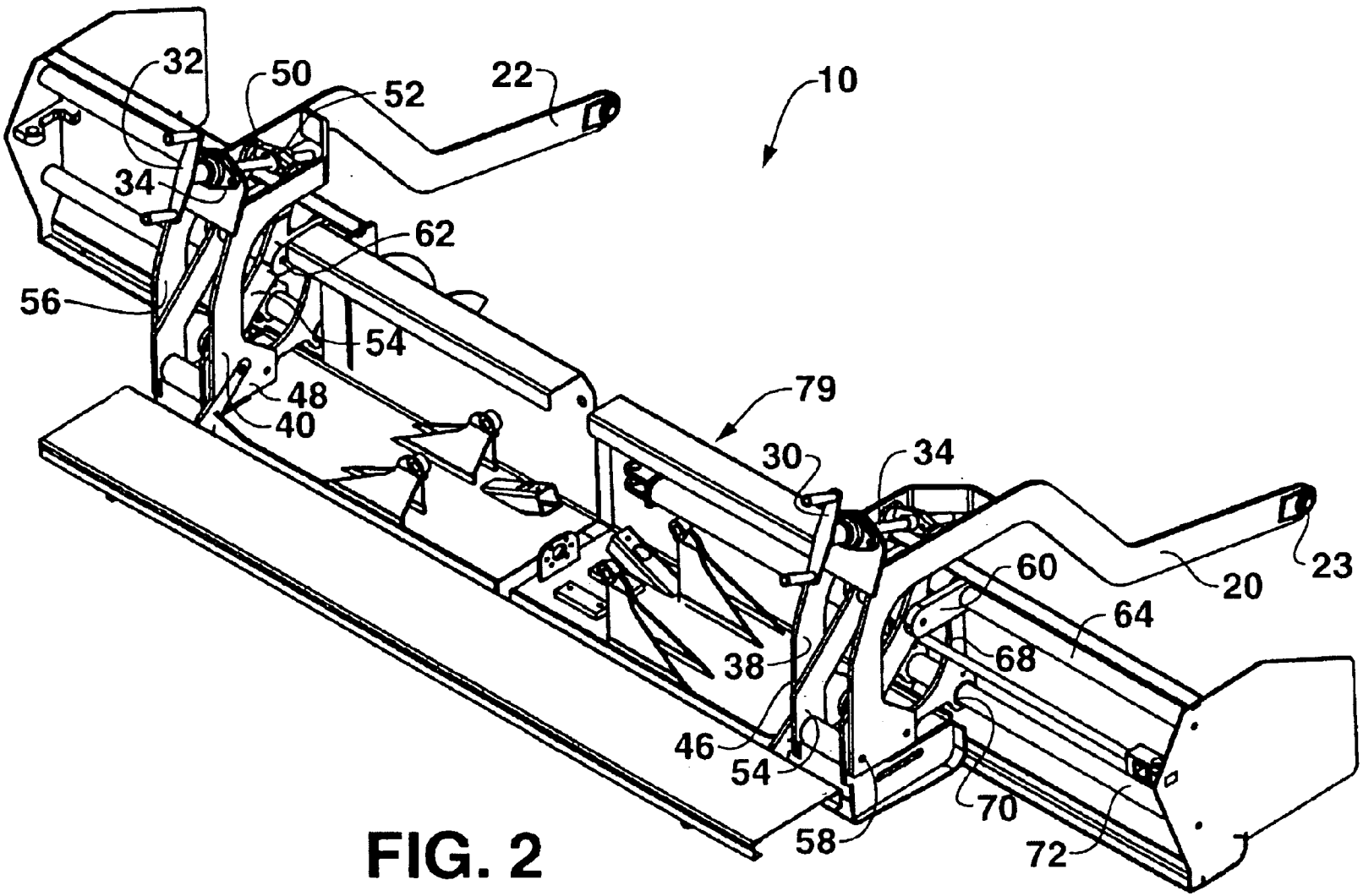
FIG. 2 is a perspective view of the adjustable screed system illustrated in FIG. 1.

FIG. 2 illustrates screed system 10 as detached from tractor T. Cranks 30, 32 are carried for rotation in journals 34 which are carried on plates 36 attached to tow arms 20, 22 and to frame members 38, 40. Tow arms 20, 22 include lower portions 42, 44 which are fixedly attached to screed 12. Lower portions 46, 48 of frame members 38, 40 are likewise fixedly connected to screed 12.

Cranks 30, 32 each include a threaded rod 50 which threadingly engages a cross member 52 which is pivotally attached between link members 54, 56, which are connected to pin 58 (FIG. 4) for pivotal movement with respect to screed 12.

Accordingly, rotation of crank 30 and/or 32 causes corresponding movement of links 54, 56 with respect to main screed 12 and tow arms 20, 22, and such turning of cranks 30, 32 causes a corresponding change in the angle of attack of main screed 12 and extension screeds 14, 16, which are slaved to the movement of main screed 12.

Connecting links 60, 62 are pivotally connected to a pin 63 (FIG. 5) in links 54, 56, respectively, at one end thereof. The other end of connecting links 60, 62 are connected to a shaft 64 on each of extension screeds 14, 16 and serve to support extension screeds 14, 16 with respect to screed 12, and also to alter and maintain changes in the angle of attack of extension screeds 14, 16 with respect to main screed 12, when cranks 30, 32 are selectively rotated.

Generally L-shaped link members-68 also connect extension screeds 14, 16 to main screed 12. Links 68 include openings 70 for receipt of a shaft 72 carried in each of extension screeds 14, 16. Links 70 also include a bore 74 for receipt of a pivot pin 76 and also a bore 78 for receipt of shaft 64. Each of bores 70, 74, and 78 allow for pivoting of links 68 with respect to shaft 72, pin 76 (FIG. 5), and shaft 64, respectively, to allow adjustment of extension screeds 14, 16 with respect to main screed 12 in proper relationship, as necessary during paving. It is noted that shafts 64, 72 act as guide rods for extension of screeds 14, 16, which themselves are carried in housings, generally 79.

Figure 3:
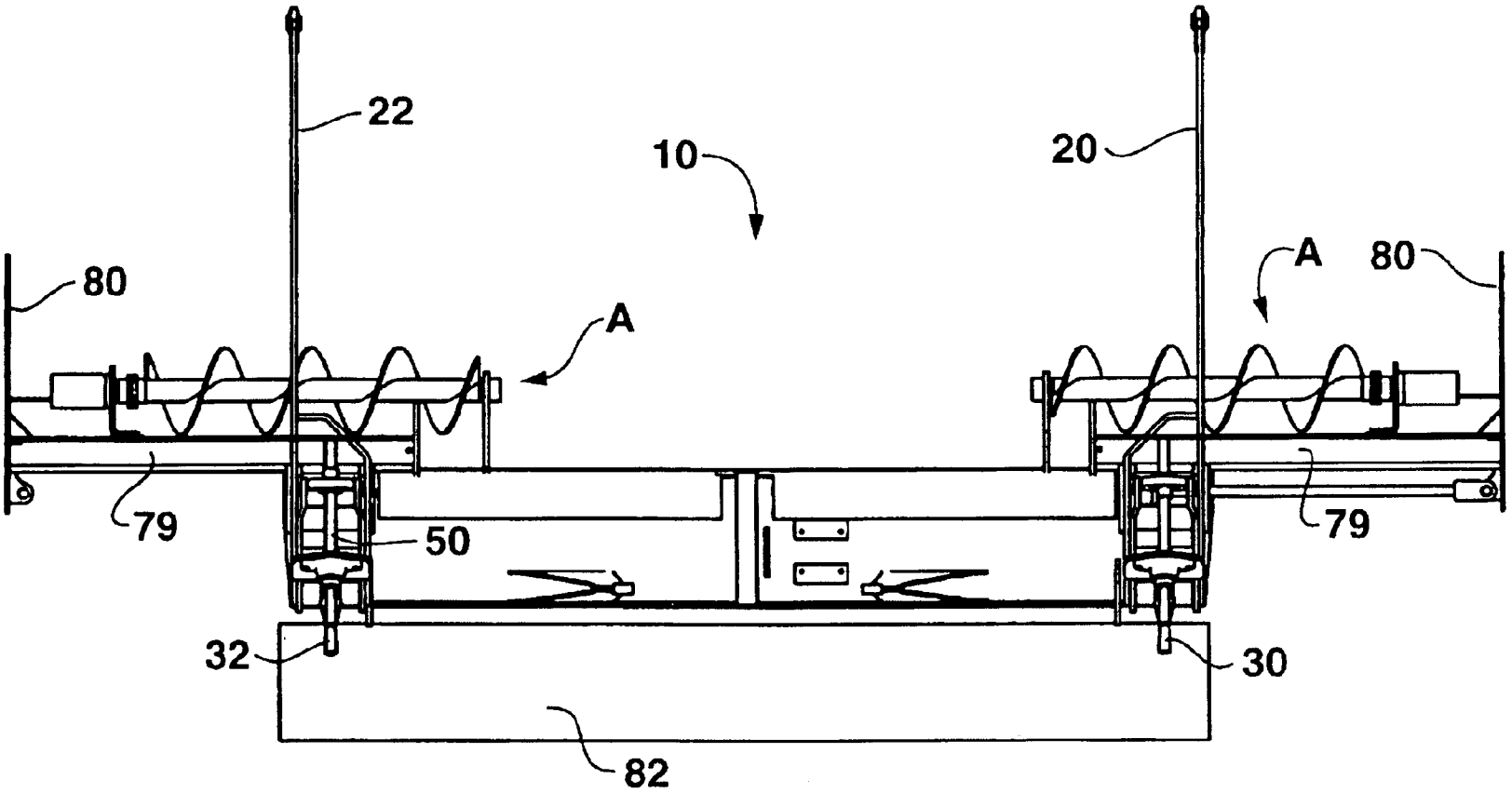
FIG. 3 is a plan view of an adjustable screed system constructed in accordance with the present invention.

FIG. 3 illustrates transport augers, generally A, which travel with screed extensions 14, 16 to transport asphalt deposited by hopper H (FIG. 1) of tractor T during operation. Strike off-plates, generally 80, may be provided at the extreme ends of extensions 14, 16, for containing asphalt from spilling outward during paving. Main screed 12 includes a walkway, generally 82, on which an operator may stand during operation of paver P.

Figure 4:
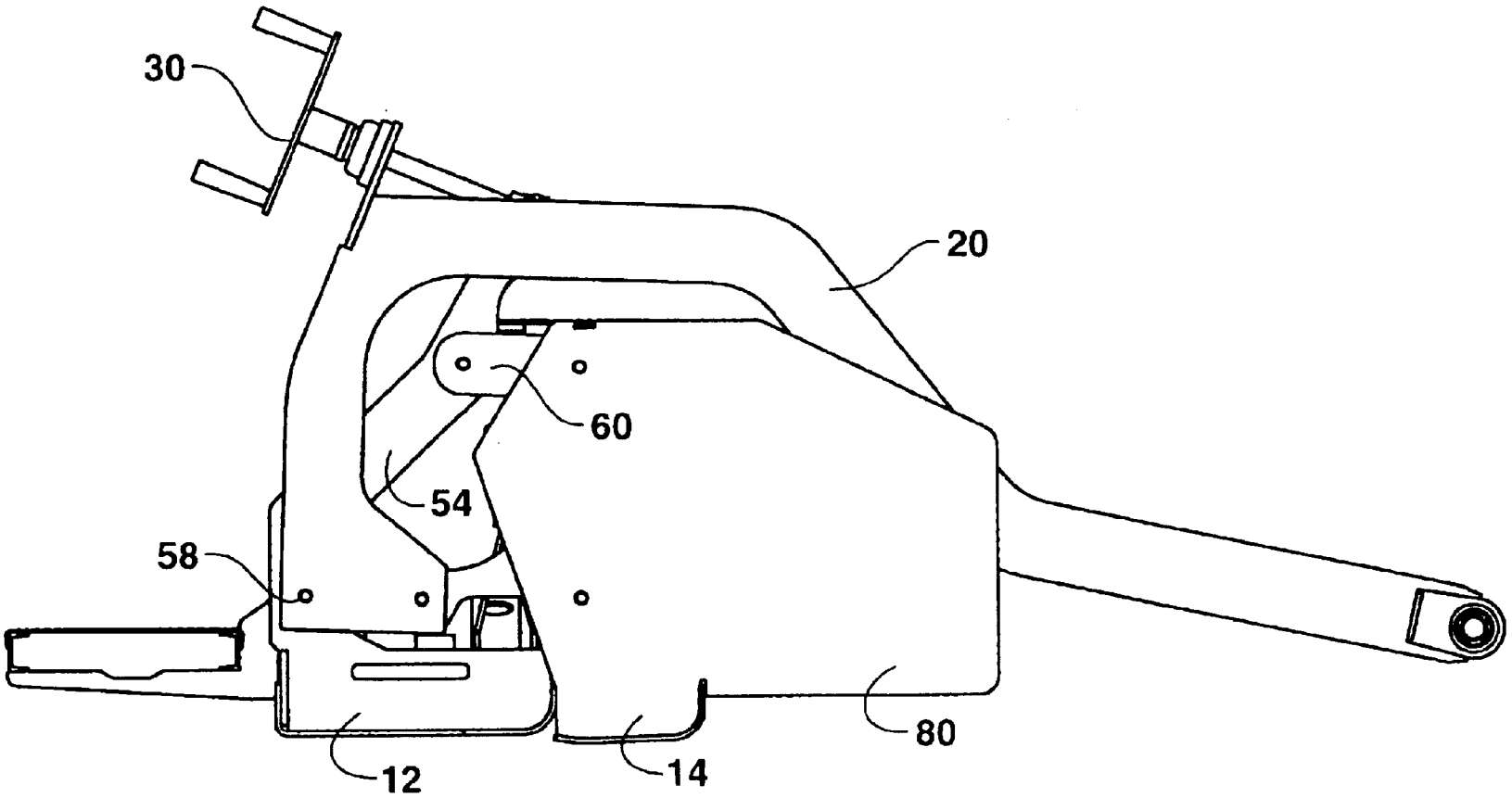
FIG. 4 is a side elevational view of an adjustable screed system constructed in accordance with the present invention.
Figure 5:
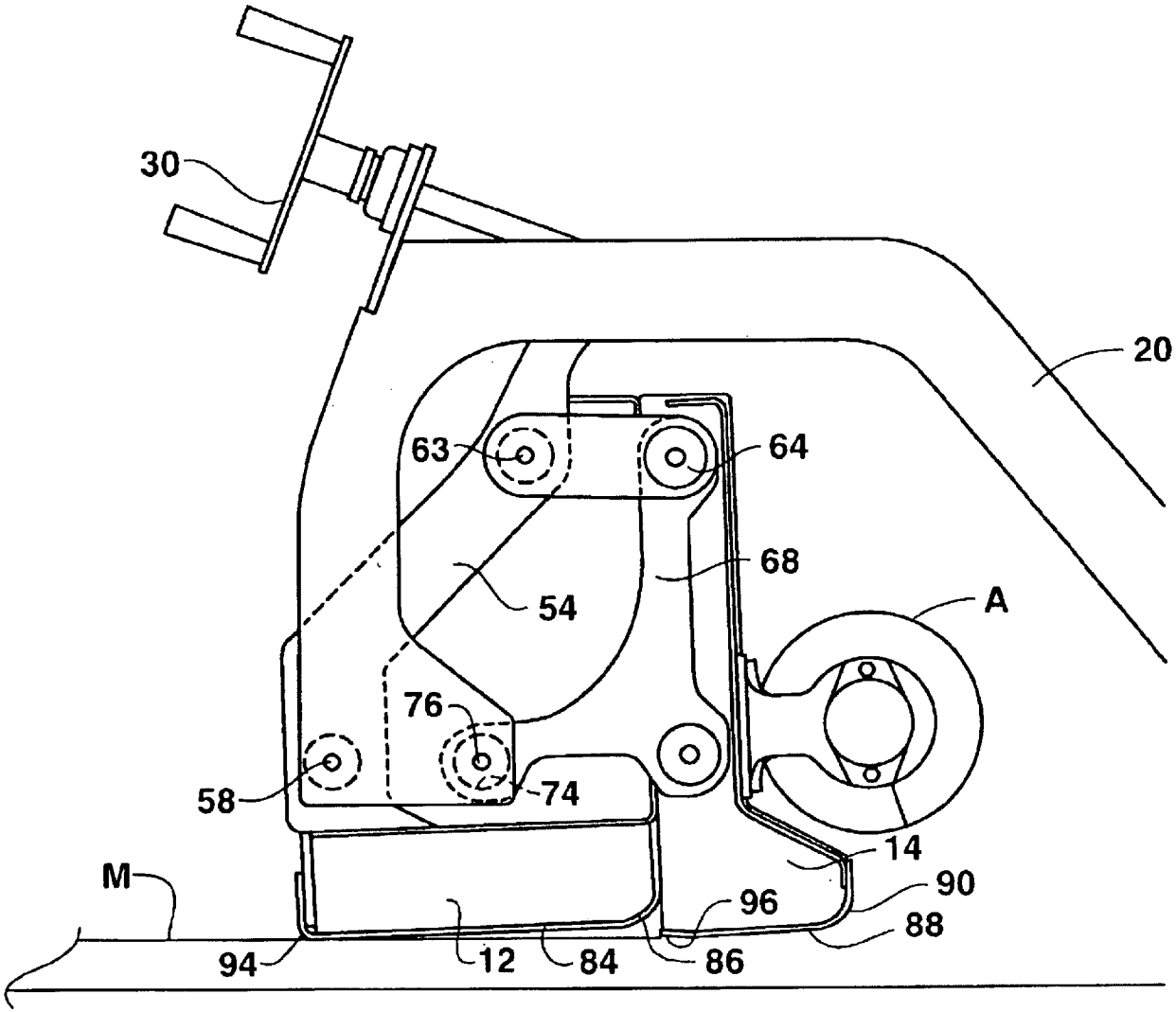
FIG. 5 is a side elevational view of an adjustable screed system constructed in accordance with the present invention, in a paving position.

FIGS. 4 and 5 illustrate screed system 10 in an operative paving position from the right side, as shown in FIG. 3, although it is to be understood that the description of construction and operation of the right side of screed system 10 also applies to the left side as well. In particular, FIG. 5 illustrates an asphalt mat, generally M, having been formed as screed system 10 is pulled forward, in a direction to the right, shown in FIG. 5. Main screed 12 includes a screed plate, generally 84, having a curved leading edge portion, generally 86. Extension screed 14 also includes a screed plate, generally 88, having a curved leading edge portion, generally 90.

Figure 6:
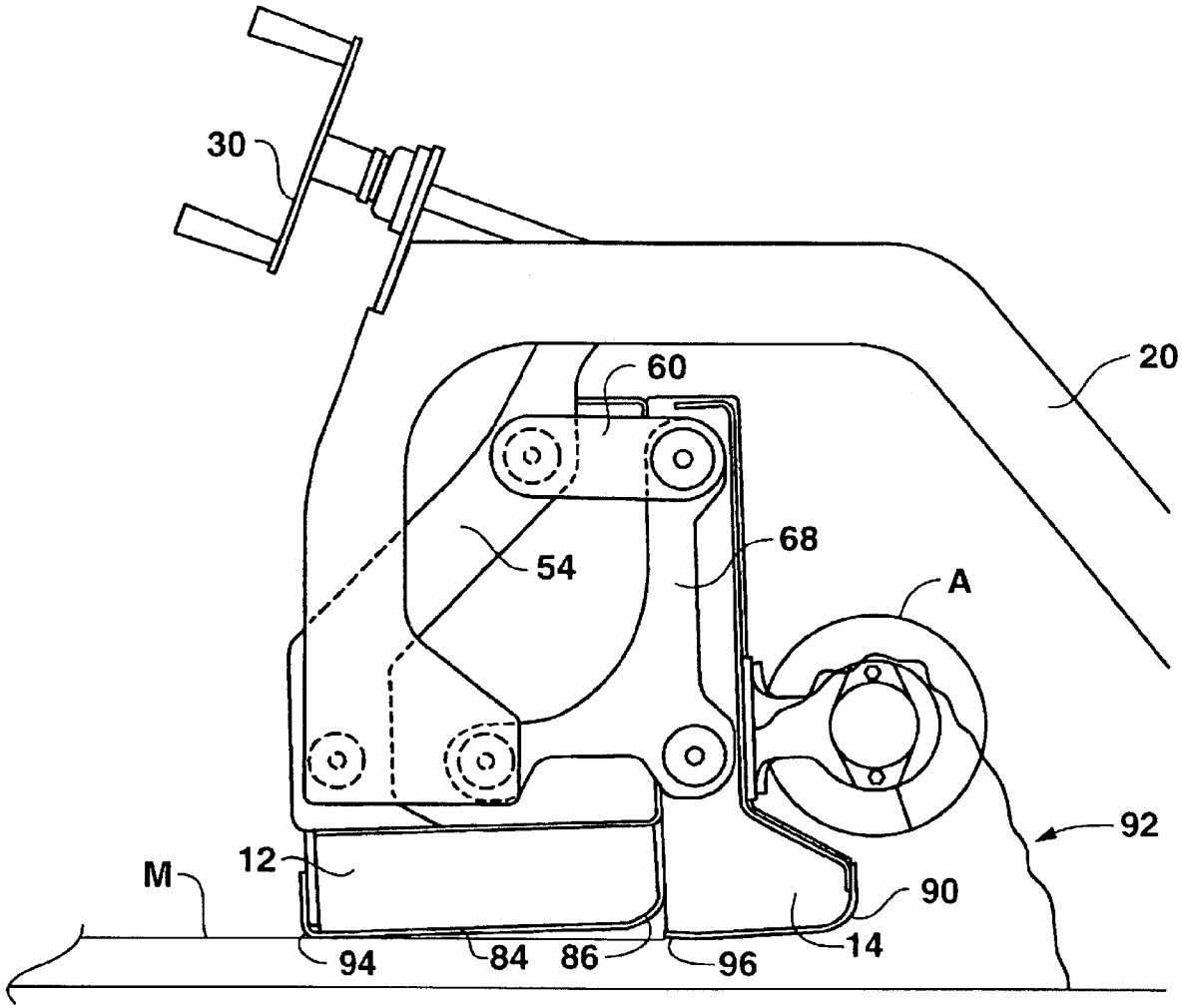
FIG. 6 is a side elevational view of the adjustable screed system shown in FIG. 5 showing asphalt in engagement with a transport auger.

As shown in FIG. 6, asphalt 92 has been deposited by hopper H and has been transported by auger A to position along the leading edge 90 of extension screed 14. As can be seen from FIG. 6, both screeds 12 and 14 are angled upwardly from trailing edges 94, 96, respectively thereof, and this upward angle is known as the "angle of attack" of screeds 12, 14. As tractor T moves forwardly, asphalt 90 is received beneath leading edges 90 and 86 of screeds 14, 12, respectively, and due to the weight of screed system 10 and the downwardly inclined angle of screed plates 84 and 88, asphalt 90 is compacted and compressed to ultimately form asphalt mat M, as trailing edge 94 of screed 12 passes over asphalt 90.

EXAMPLE

Figure 7:
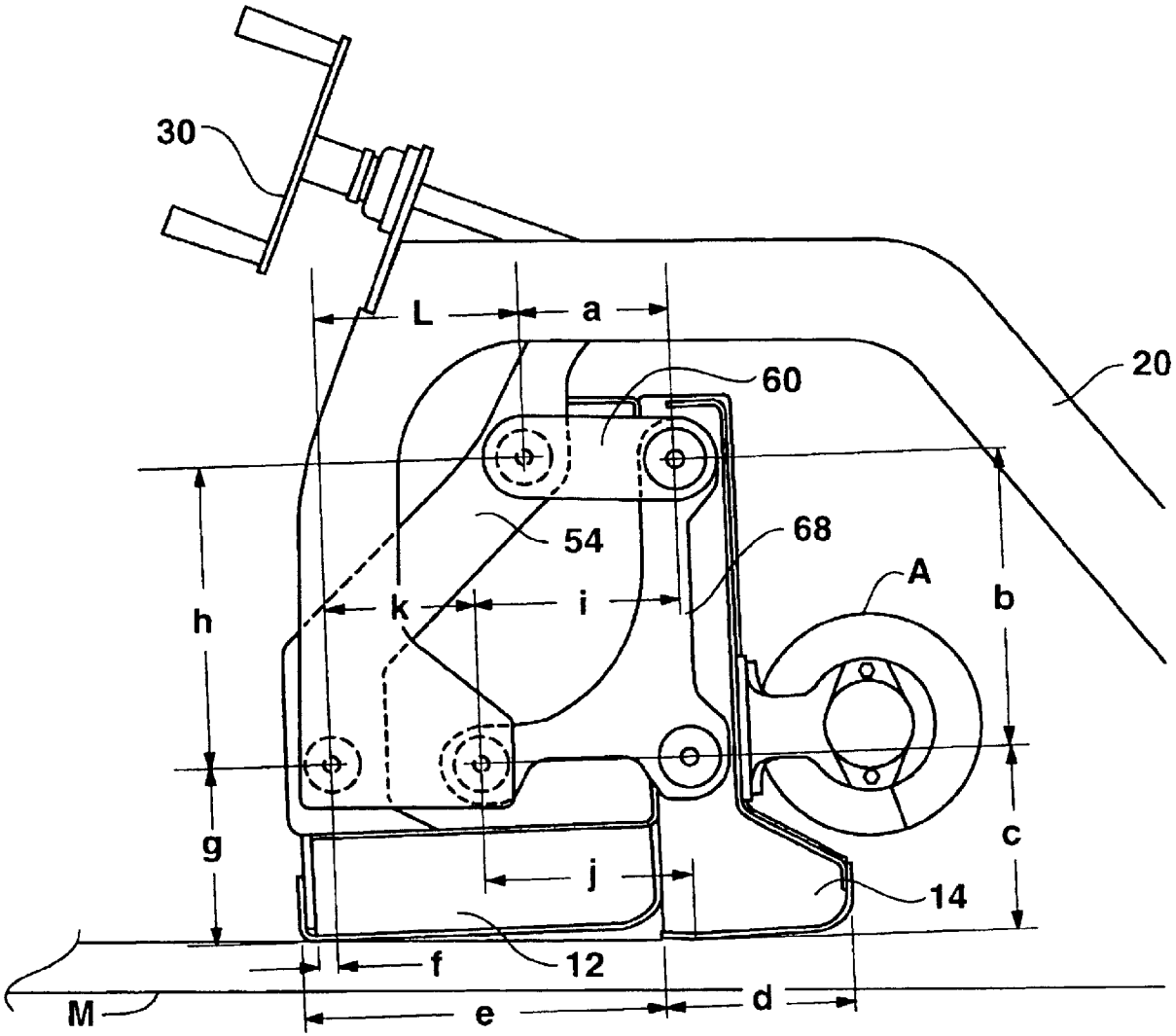
FIGS. 7 and 8 are dimensioned views of an adjustable screed system constructed in accordance with the present invention.

FIG. 7 illustrates certain example dimensions of one preferred embodiment of the present invention, for a screed system 10 constructed of steel and weighing of approximately lbs, such dimensions shown in tabular form below:

| Reference Character | Dimension In Inches |
|---|---|
| a | 6.02 |
| b | 12.00 |
| c | 7.55 |
| d | 7.57 |
| e | 14.50 |
| f | 1.00 |
| g | 7.25 |
| h | 12.00 |
| i | 8.25 |
| j | 8.20 |
| k | 6.02 |
| l | 8.25 |

Figure 8:
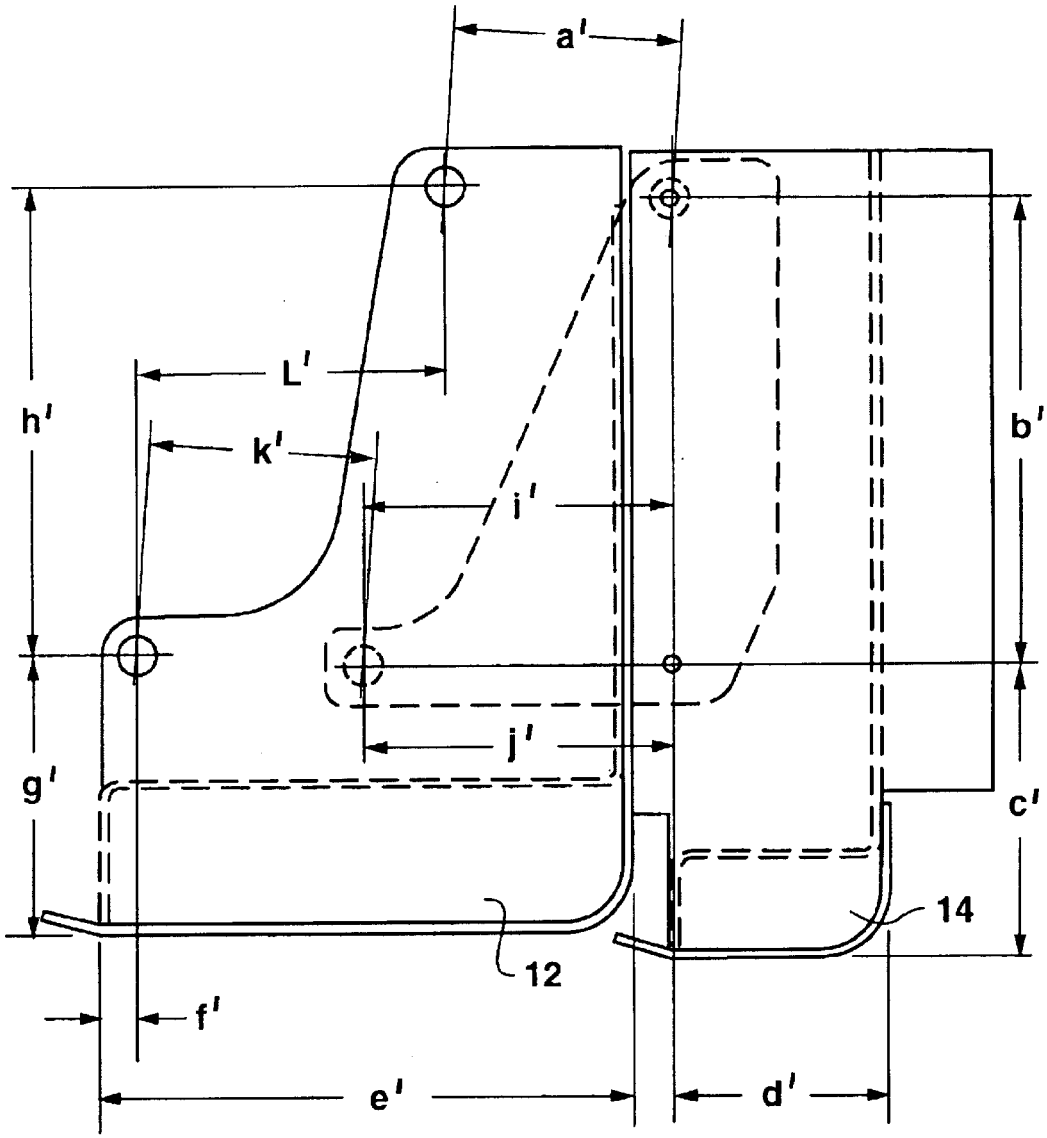

FIG. 8 illustrates dimensions for the same embodiment shown in FIG. 7, except that in the FIG. 8 illustration, the angle of attack of screeds 12, 14 is substantially zero.

| Reference Character | Dimension In Inches |
|---|---|
| a' | 6.028 |
| b' | 12.000 |
| c' | 7.550 |
| d' | 5.750 |
| e' | 14.250 |
| f' | 1.000 |
| g' | 7.250 |
| h' | 12.000 |
| i' | 8.250 |
| j' | 8.22 |
| k' | 6.028 |
| l' | 8.250 |

While the foregoing examples set forth specific dimensions of components of the present invention, it is to be understood that the present invention is not to be limited to such embodiment and dimensions, and that the present invention could be in a variety of other configurations, in accordance with the teachings and disclosure of the invention herein.

Figure 9A:
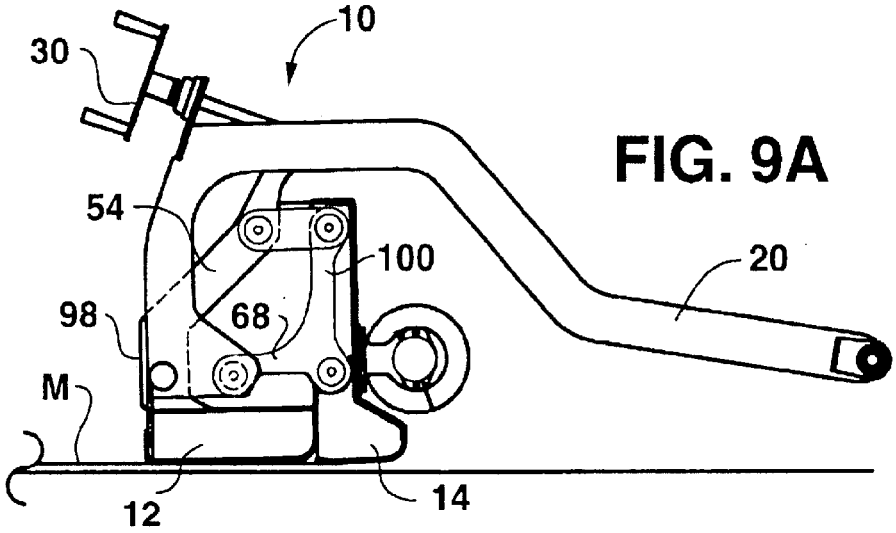
FIGS. 9A through 9C are side elevational views of an adjustable screed system constructed in accordance with the present invention shown in use paving asphalt mats of varying thicknesses.
Figure 9B:
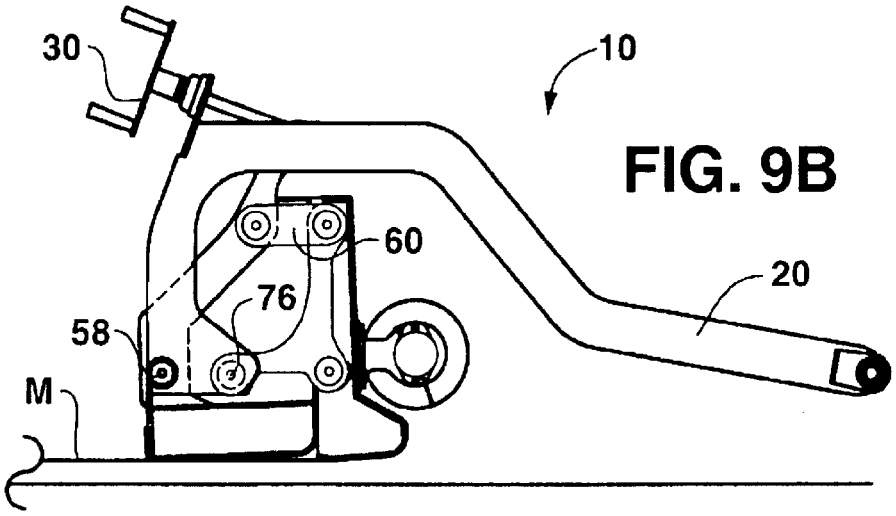
Figure 9C:
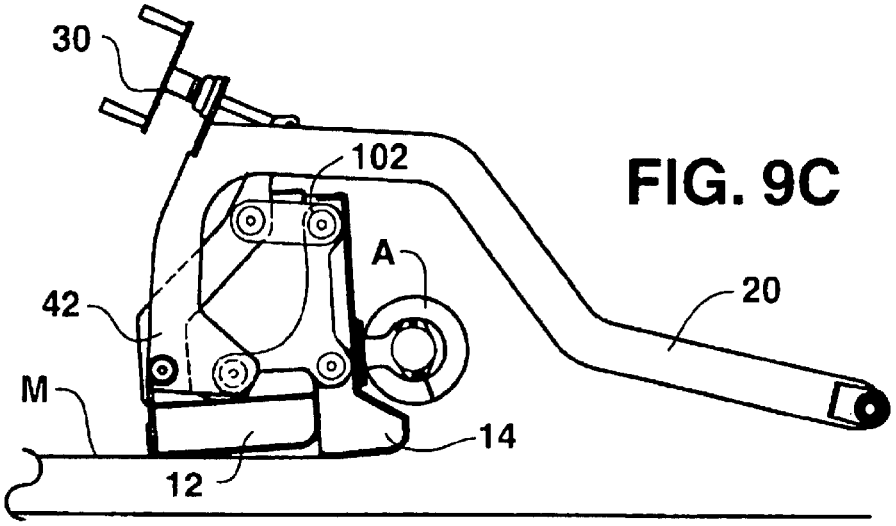

FIGS. 9A, 9B, and 9C illustrate screed system 10 in use paving asphalt mats M of varying thickness. For example, in FIG. 9A, the asphalt mat M could be approximately three-quarters of an inch. Note the relatively slight angle of attack of screeds 12 and 14. Note also that link 60 is generally horizontal and that the back edge 98 of link 54 is substantially vertical. Similarly, upstanding leg 100 of link 68 is generally vertical.

In FIG. 9B, the operator has rotated crank 30 in order to increase the angle of attack of screed 12. This single adjustment by the operator simultaneously causes a corresponding change in the angle of attack of screed 14 such that the angular relationship of extension screed 14 with respect to screed 12 is maintained. Note also from FIG. 9B that link 68 has moved upward slightly due to the increase in the angle of attack. An example mat thickness as shown in FIG. 9B could be two inches.

In FIG. 9C, a mat thickness of approximately five inches is being formed. The operator, at this point, has further rotated crank 30 to further increase the angle of attack of screeds 12 and 14. Note that the lower portion 42 of link 68 has risen further, and that the back edge 98 of link 54 is now inclined rearwardly. Also, leg 100 of link 68 is now rearwardly inclined, and the forward end 102 of link 60 is now downwardly inclined. Through the range of motion shown in FIGS. 9A through 9C, the angle of attack relationship between screeds 12 and 14 remains generally constant such that the mat M formed by screed 14 is at essentially the same height as mat M formed by screed 12, thereby eliminating any discontinuity, or step, between the mats, and also, the mats formed by screeds 12 and 14 have essentially the same surface finish.

Figure 10:
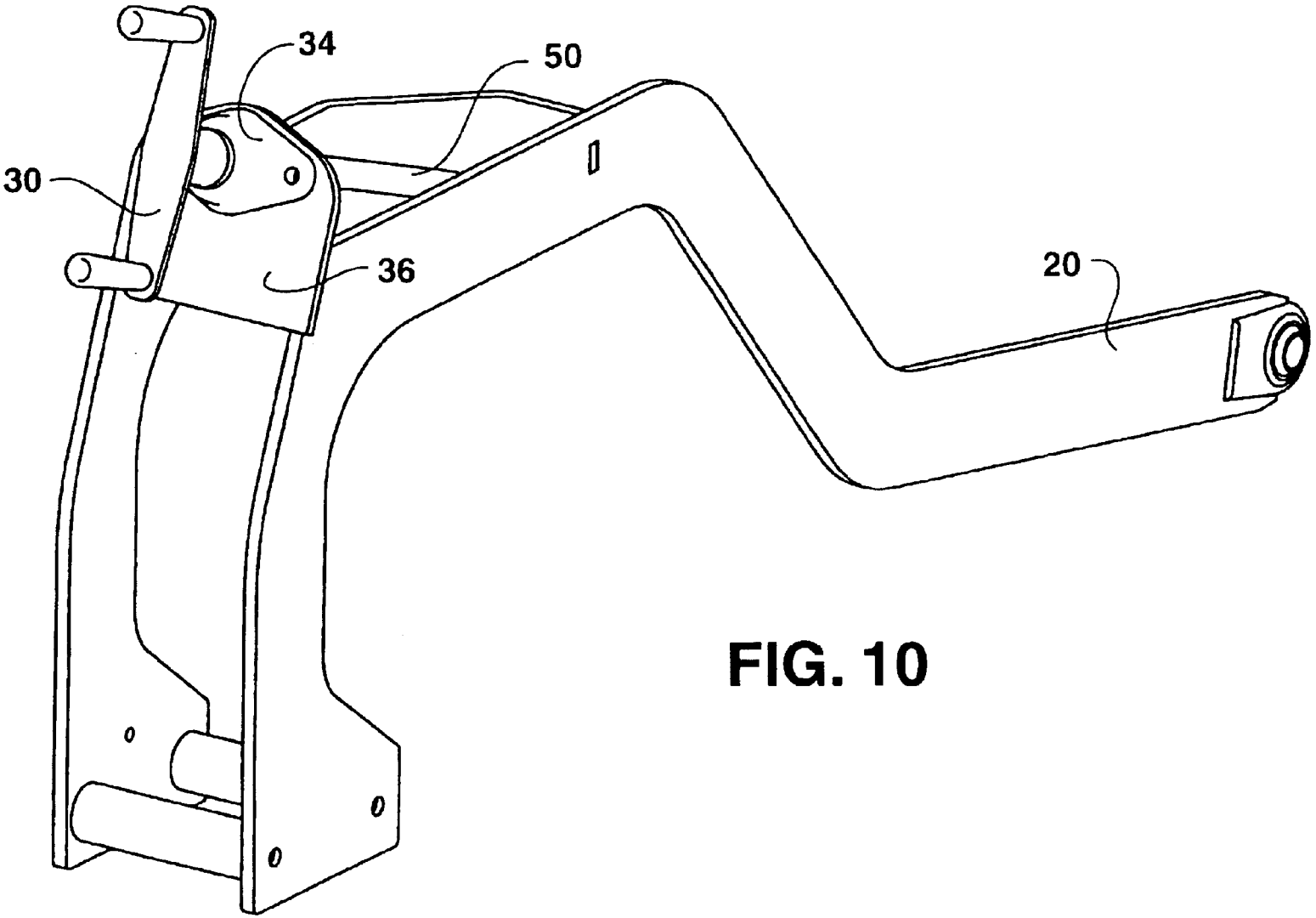
FIG. 10 is a perspective view of a tow bar arrangement constructed in accordance with the present invention.

FIG. 10 illustrates tow arm structure 20 and the connection of crank 30 via plate 104 thereto.

The distance between the two pivot pins 58, 76 of tow arms 20, 22 is preferably matched to the distance between the two pivot pins 63, 64 of upper link 60. This creates parallel motion between main screed 12 and extension screed 14 when screed 12 is moved by crank 30. The bottom of extension screed 14 is mounted to housing 79 at the desired angle of attack for optimum paving performance relative to the main screed 12 during initial set up. Thus, the parallel motion of the linkage 60 and the link formed by the lower portion of arm 20 between the two pivot pins 58, 76 keep the angular relationship between extension screed 14 and main screed 12 substantially the same through the normal range of paving depths.

The main screed 12 trailing edge 94 is preferably located a slight distance behind the center of the rear pivot pin 58 of tow arm 20. The trailing edge 96 of screed 14 is a significantly further distance forward of the front pivot pin 76 of tow arm 20, and this difference allows for relative motion of the trailing edge 94 of the main screed with respect to the trailing edge 96 of the extension screed 14. The direction and amount pf pivotal motion of the screeds per degree of attack angle depends on the tow arm length, the weight of the screed, the physical dimensions of the main screed and extension screed plates, and the position of extension screed 14 with respect to the attack angle of main screed 12. Matching the amount of motion per degree of angle change in the main screed 12 allows the screed extension 14 to be matched to the main screed 12 with minimal error through a reasonable range of paving depths, for example, from three-quarter inches to six inches in depth, without requiring the operator to make any adjustments to correct the extension screed 14 elevation.

Figure 11:
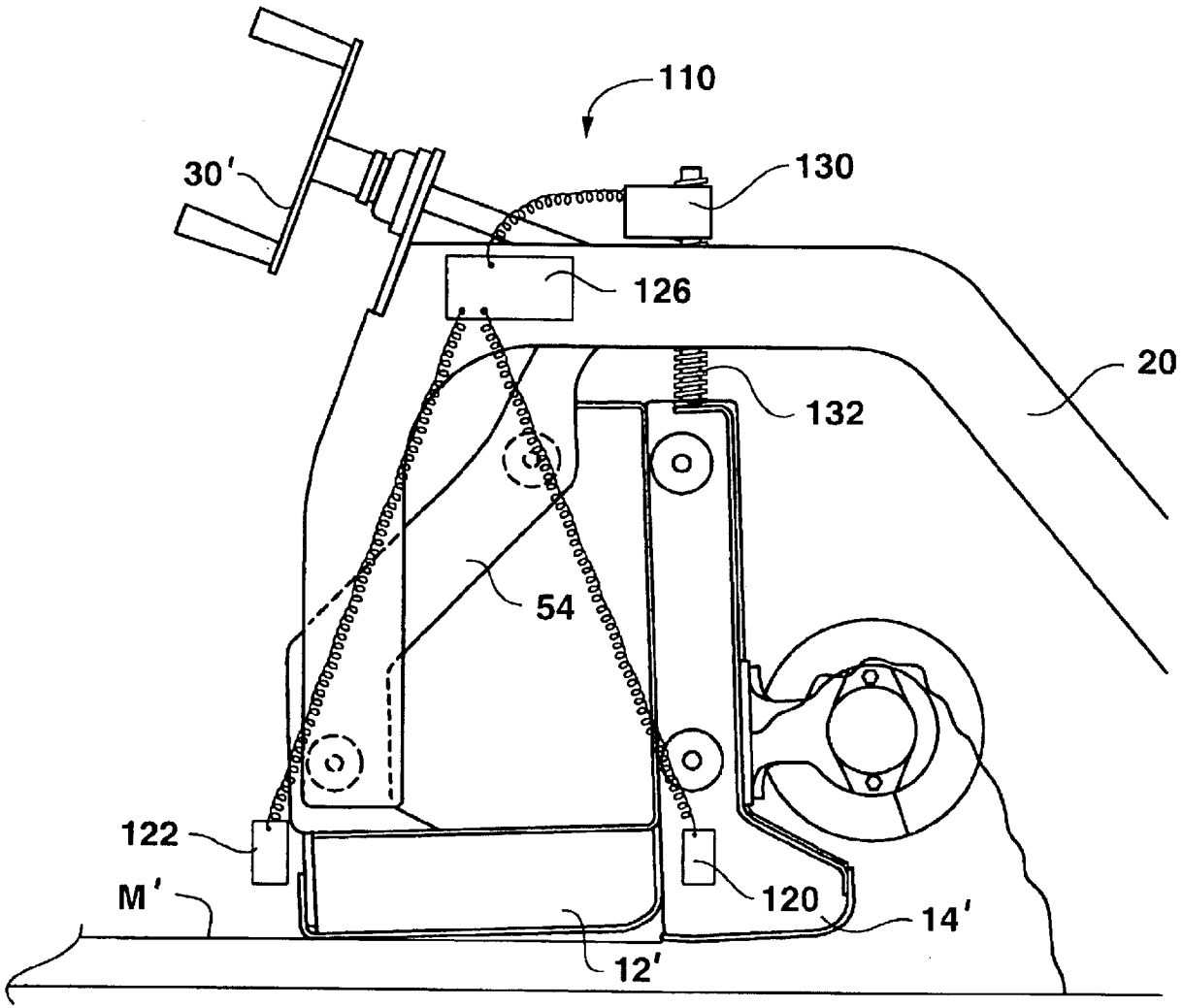
FIG. 11 is a schematic representation of an alternate embodiment adjustable screed system constructed in accordance with the present invention, which uses powered actuators for adjusting the respective heights and angles of attack of a main screed and an extension screed.

FIG. 11 illustrates an alternate embodiment of the present invention. Adjustable screed system 110 does not require the linkages discussed above with respect to screed system 10. Instead, sensors 120, 122 (which can be of conventional design) are provided on extension screed 14' and main screed 12'. Sensors 120 and 122 are positioned near the trailing edge of each of screeds 14', 12' to determine the elevation of the mats M' formed respectively by screeds 14' and 12'. Sensors 120, 122 output to a conventional controller, generally 126, such as a programmable logic controller (PLC), microprocessor, or the like, with the respected mat elevation data. The controller 126 includes a set point adjustment and feedback control loop which, in response to the data input from sensors 120, 122, provides a signal to an actuator, generally 130, such as a reversible motor, stepping motor, or the like, which drives an adjusting rod 132 to raise or lower screed extension 14' with respect to main screed 12'. Alternately, instead of using an actuator 130, controller 126 could output a correction signal, to an output, such as a meter, LED readout, an audible signal, etc. (none shown) to the operator, the operator could then adjust a crank (not shown) accordingly, to selectively adjust the height of extension screed 14'.

The present invention is not limited to the mechanical linkages illustrated or described herein, and linkages of a variety of other configurations could be designed without departing from Applicant's invention. The present invention provides the operator with one less operation to monitor and control while also improving the surface of the asphalt mat formed. Further, the present invention of automatically compensating for screed extension height can be accomplished on existing screed designs, without using a linkage system, but instead by incorporating controls which are added to the extension and a powered actuator for adjusting the extension depth. The powered actuator, depth sensors and controllers, could extend the present invention to application on conventional pavers, while achieving substantially the same end result of the present self-compensating screed extension disclosed herein.

While preferred embodiments of the invention have been described using specific terms, such description is for a present illustrative purposes only, and it is to be understood that changes and variations to such embodiments, including, but not limited to, the substitution of equivalent features or parts, and the reversal of various features thereof, may be practiced by those of ordinary skill in the art without departing from the spirit or scope of the present disclosure.

What is claimed is:

1. A screed system for a paving apparatus for screeding pavement at a desired paving height, comprising:

a first screed, said first being elongated and configured to move to a predetermined paving height;

a second screed, said second screed being elongated and movable longitudinally outwardly with respect to said first screed;

said second screed being configured to move to said predetermined paving height;

a first link pivotally connected to said first screed and pivotally connected to said second screed;

a second link pivotally connected to said first link and pivotally connected to said second screed;

an actuator connected to said first screed for selectively moving said first screed to said predetermined paving height;

said first link and said second link being configured for automatically moving said second screed to substantially said predetermined paving height upon said first screed being moved to said predetermined paving height;

a tow bar, said tow bar having a first pivotal connector pivotally connecting said tow bar to said first screed and a second pivotal connector pivotally connecting said tow bar to said second link;

said first pivotal connector and said second pivotal connector defining a first distance therebetween;

and wherein said first link includes a third pivotal connector for pivotally connecting said first link to said first screed and a fourth pivotal connector for pivotally connecting said first link to said second link;

said third pivotal connector and said fourth pivotal connector defining a second distance therebetween; and wherein said first distance and said second distance are substantially equal.

2. A screed system for a paving apparatus for screeding pavement at a desired paving height, comprising:

a first screed, said first being elongated and configured to move to a predetermined paving height;

a second screed, said second screed being elongated and movable longitudinally outwardly with respect to said first screed;

said second screed being configured to move to said predetermined paving height;

a first link pivotally connected to said first screed and pivotally connected to said second screed;

a second link pivotally connected to said first link and pivotally connected to said second screed;

an actuator connected to said first screed for selectively moving said first screed to said predetermined paving height;

said first link and said second link being configured for automatically moving said second screed to substantially said predetermined paving height upon said first screed being moved to said predetermined paving height;

a tow bar, said tow bar having a first pivotal connector pivotally connecting said tow bar to said first screed and a second pivotal connector pivotally connecting said tow bar to said second link;

and wherein said first screed includes a first leading portion and a first trailing edge, and said second screed includes a second leading portion and a second trailing edge; and wherein said first trailing edge is rearward of said first pivotal connector and said second trailing edge is forward of said second pivotal connector.

3. A screed system for a paving apparatus for screeding pavement at a desired paving height, comprising:

a first screed configured to move within a range of paving heights;

said range of paving heights being from approximately ¾ inches to six inches;

a second screed configured to move within said range of paving heights;

a mechanical linkage connected to said first screed and said second screed, said mechanical linkage slaving movement of said second screed to movement of said first screed as said first screed is moved within said range of paving heights;

said mechanical linkage being of a predetermined geometry and configured to maintain said second screed at substantially the same paving height as said first screed throughout movement of said first screed within said range of paving heights; and a crank connected to said first screed for moving said first screed within said range of paving heights.

4. A screed system for a paving apparatus for screeding pavement at a desired paving height, comprising:

a first screed, said first being elongated and configured to move to a predetermined paving height;

a second screed, said second screed being elongated and movable longitudinally outwardly with respect to said first screed;

said second screed being configured to move to said predetermined paving height;

a first link pivotally connected to said first screed and pivotally connected to said second screed;

a second link pivotally connected to said first link and pivotally connected to said second screed;

an actuator connected to said first screed for selectively moving said first screed to said predetermined paving height;

said first link and said second link being configured for automatically moving said second screed to substantially said predetermined paving height upon said first screed being moved to said predetermined paving height;

a tow bar having a first pivotal connector pivotally connecting said tow bar to said first screed and a second pivotal connector pivotally connecting said tow bar to said second link; and and wherein said first link includes a third pivotal connector for pivotally connecting said first link to said first screed and a fourth pivotal connector for pivotally connecting said first link to said second screed.

5. The screed system as defined in claim 4, wherein said actuator is a hand crank.

6. The screed system as defined in claim 4, further comprising:

said actuator being connected to said tow bar and said first screed, such that upon actuation of said actuator, said first screed moves relative to said tow bar.

7. The screed system as defined in claim 4, wherein said second link is generally L-shaped.

8. A screed system for a paving apparatus for screeding pavement at a desired paving height, comprising:

a first screed configured to move to a predetermined paving height;

a second screed movable generally longitudinally outwardly with respect to said first screed;

said second screed being configured to move to said predetermined paving height;

a first link pivotally connected to said first screed and pivotally connected to said second screed;

a second link pivotally connected to said first link and pivotally connected to said second screed;

an actuator connected to said first screed for selectively moving said first screed to said predetermined paving height;

said first link and said second link being configured for automatically moving said second screed to substantially said predetermined paving height upon said first screed being moved to said predetermined paving height; and a tow bar having a first pivotal connector pivotally connecting said tow bar to said first screed and a second pivotal connector pivotally connecting said tow bar to said second link.

9. A screed system for a paving apparatus for screeding pavement at a desired paving height, comprising:

a first screed configured to move to a predetermined paving height;

a second screed movable generally longitudinally outwardly with respect to said first screed;

said second screed being configured to move to said predetermined paving height;

means for automatically moving said second screed to substantially said predetermined paving height upon said first screed being moved to said predetermined paving height; and a tow bar having a first pivotal connector pivotally connecting said tow bar to said first screed and a second pivotal connector pivotally connecting said tow bar to said second screed.

10. A screed system for a paving apparatus for screeding pavement at a desired paving height, comprising:

a first screed configured to move to a first angle of attack for screeding at a predetermined paving height;

a second screed configured to move generally longitudinally outwardly with respect to said first screed;

said second screed being configured to move to a second angle of attack for screeding at said predetermined paving height;

means for automatically moving said second screed to said second angle of attack for screeding at substantially said predetermined paving height upon said first screed being moved to said first angle of attack; and a tow bar having a first pivotal connector pivotally connecting said tow bar to said first screed and a second pivotal connector pivotally connecting said tow bar to said second screed.

11. A screed system for a paving apparatus for screeding pavement over a surface at a desired paving height, comprising:

a first screed having a first screeding plane configured to move to a first angle of attack with respect to the surface for screeding at a predetermined paving height;

a second screed movable generally longitudinally outwardly with respect to said first screed;

said second screed having a second screeding plane configured to move to a second angle of attack with respect to the surface for screeding at said predetermined paving height;

means for automatically varying said second angle of attack upon said first screed plane being moved to said first angle of attack such that said first screed plane and said second screed plane are positioned for paving at substantially said predetermined paving height; and a tow bar having a first pivotal connector pivotally connecting said tow bar to said first screed and a second pivotal connector pivotally connecting said tow bar to said second screed.

12. A screed system for a paving apparatus for screeding pavement at a desired paving height, comprising:

a first screed configured to move to a predetermined paving height;

a second screed movable generally longitudinally outwardly with respect to said first screed;

said second screed being configured to move to said predetermined paving height;

means for simultaneously moving said second screed to substantially said predetermined paving height upon said first screed being moved to said predetermined paving height; and a tow bar having a first pivotal connector pivotally connecting said tow bar to said first screed and a second pivotal connector pivotally connecting said tow bar to said second screed.

13. A screed system for a paving apparatus for screeding pavement at a desired paving height, comprising:

a first screed configured to move between a first paving height and a second paving height;

a second screed movable generally longitudinally outwardly with respect to said first screed;

said second screed being configured to move between said first paving height and said second paving height;

means for automatically moving said second screed to said second paving height responsive to said first screed being moved from said first paving height to said second paving height; and a tow bar having a first pivotal connector pivotally connecting said tow bar to said first screed and a second pivotal connector pivotally connecting said tow bar to said second screed.

14. A screed system for a paving apparatus for screeding pavement at a desired paving height, comprising:

a first screed configured to move to a predetermined paving height;

a second screed movable longitudinally outwardly with respect to said first screed;

said second screed being configured to move to said predetermined paving height;

an actuator connected to said first screed for selectively moving said first screed to said predetermined paving height;

means for automatically moving said second screed to substantially said predetermined paving height upon said first screed being moved to said predetermined paving height;

a tow bar having a first pivotal connector pivotally connecting said tow bar to said first screed and a second pivotal connector pivotally connecting said tow bar to said second screed;

said first screed including a first leading portion and a first trailing edge;

said second screed including a second leading portion and a second trailing edge; and said first trailing edge being rearward of said first pivotal connector and said second trailing edge being forward of said second pivotal connector.

* * * * *